US011246348B1

(12) United States Patent
Han et al.

(10) Patent No.: US 11,246,348 B1
(45) Date of Patent: Feb. 15, 2022

(54) ELECTROMAGNETIC ALLY-DRIVEN LIQUID ATOMIZATION DEVICE

(71) Applicant: CHINA TOBACCO YUNNAN INDUSTRIAL CO., LTD, Kunming (CN)

(72) Inventors: Yi Han, Kunming (CN); Shoubo Li, Kunming (CN); Tinghua Li, Kunming (CN); Donglai Zhu, Kunming (CN); Xiaowei Gong, Kunming (CN); Xi Lv, Kunming (CN); Jun Wu, Kunming (CN); Xia Zhang, Kunming (CN); Wei Zhao, Kunming (CN); Liu Hong, Kunming (CN)

(73) Assignee: CHINA TOBACCO YUNNAN INDUSTRIAL CO., LTD, Kunming (CN)

( * ) Notice: Subject to any disclaimer, the term of this patent is extended or adjusted under 35 U.S.C. 154(b) by 0 days.

(21) Appl. No.: 17/426,638

(22) PCT Filed: Aug. 12, 2020

(86) PCT No.: PCT/CN2020/108660

§ 371 (c)(1),
(2) Date: Jul. 29, 2021

(87) PCT Pub. No.: WO2021/139155

PCT Pub. Date: Jul. 15, 2021

(30) Foreign Application Priority Data

Aug. 7, 2020 (CN) ..... 202010788548.2

(51) Int. Cl.
*A24F 13/00* (2006.01)
*A24F 40/465* (2020.01)
(Continued)

(52) U.S. Cl.
CPC ..... *A24F 40/465* (2020.01); *A24F 40/10* (2020.01); *A24F 40/50* (2020.01)

(58) Field of Classification Search
CPC ..... A24F 47/00
(Continued)

(56) References Cited

U.S. PATENT DOCUMENTS

2017/0086505 A1 3/2017 Cameron
2021/0339270 A1* 11/2021 Tuz ..... B01D 17/042

FOREIGN PATENT DOCUMENTS

CN 101524187 A 9/2009
CN 104000306 A 8/2014
(Continued)

*Primary Examiner* — Phuong K Dinh
(74) *Attorney, Agent, or Firm* — Bayramoglu Law Offices LLC

(57) ABSTRACT

An electromagnetically-driven liquid atomization device includes an atomizing core and an electromagnetic drive unit, where the atomizing core includes a liquid storage tank and an electrical heating element; the electrical heating element is provided above a droplet releasing hole, such that a surface of the electrical heating element and the droplet releasing hole are opposite and spaced apart by a certain distance; the electromagnetic drive unit is provided at the bottom of the atomizing core. The electromagnetically-driven liquid atomization device of the present disclosure features small size, quantitative liquid supply, small-volume liquid atomization, controllable droplet formation and liquid surface shape, and no liquid leakage.

9 Claims, 5 Drawing Sheets

(51) Int. Cl.
*A24F 40/50* (2020.01)
*A24F 40/10* (2020.01)

(58) Field of Classification Search
USPC ..... 131/328–329
See application file for complete search history.

(56) References Cited

FOREIGN PATENT DOCUMENTS

| | | | |
|---|---|---|---|
| CN | 105011379 | A | 11/2015 |
| CN | 108095197 | A | 6/2018 |
| CN | 108523246 | A | 9/2018 |
| KR | 102074931 | B1 | 2/2020 |

* cited by examiner

ELECTROMAGNETIC ALLY-DRIVEN LIQUID ATOMIZATION DEVICE

CROSS REFERENCE TO THE RELATED APPLICATIONS

This application is the national phase entry of International Application No. PCT/CN2020/108660, filed on Aug. 12, 2020, which is based upon and claims priority to Chinese Patent Application No. 202010788548.2, filed on Aug. 7, 2020, the entire contents of which are incorporated herein by reference.

TECHNICAL FIELD

The present disclosure belongs to the technical field of electronic atomization, and specifically relates to a device for atomizing a liquid by electromagnetically driving the liquid and enabling an extruded part of the liquid to contact a surface of an electrical heating element.

BACKGROUND

As the core of an electronic cigarette, the atomizer has become a main focal point to the development of electronic cigarettes since its performance will directly affect the atomization efficiency, aerosol properties, inhalation quality and inhalation safety of the to-be-atomized liquid. The technologies for prior electronic cigarette atomizers typically use a heating wire as the electrical heating element. In recent years, with the advancements in technology and people's increasing awareness of safety and sensory quality, the technology for atomizers has made considerable progress. The representative technologies for atomizers include ceramic atomizing core technology, metal grid heating technology and metal sheet heating technology. The ceramic atomizing core technology uses a porous ceramic material, which is a ceramic body fabricated by high-temperature sintering, where a large number of three-dimensional pores interpenetrating each other are distributed inside the ceramic body, with a pore size that is generally on the micron or sub-micron level. Although the ceramic body is stable, resistant to high temperature, safe and easy to conduct e-liquid, it has low thermal conductivity, large thermal resistance and small volumetric heat capacity. A foreign tobacco company has developed a closed electronic cigarette that uses a metal grid heating element. The metal grid heating element features uniform heating and has a smaller resistance change rate than a traditional heating wire. Another foreign tobacco company has developed an electronic cigarette that uses a blade-type ultra-thin stainless steel to replace the traditional heating wire and e-liquid conducting core heating mechanism to heat the e-liquid into an aerosol. The ultra-thin heating sheet used has a very small thickness that is comparable to the diameter of a human hair, and has a surface area 10 times larger than that of the traditional heating wire and e-liquid conducting core heating system. Compared with the traditional heating wire, these electrical heating elements have improved heating surface areas and heating uniformity, but fail to control the delivery volume of the e-liquid, and thus cannot avoid the situation where the e-liquid accumulates on the surface of the metal grid or metal sheet or even wraps the entire electrical heating element, resulting in non-uniform heating of the e-liquid, which greatly reduces the electric heat utilization efficiency of the metal grid or metal sheet.

At present, another major problem faced by existing electronic cigarettes is the leakage of the atomizer. There are essentially two solutions. One solution is to adopt a multi-leakproof cartridge structure design, that is, to use multiple layers of e-liquid absorbing cotton, a complicated e-liquid leakproof structure and a sealing process to prevent the e-liquid from depositing and flowing out of the atomizer while locking the condensed e-liquid. The other solution is to extend the vapor path to ensure that each drop of the e-liquid is fully atomized, thereby reducing the risk of leakage. However, although the aforementioned leakproof structures and technologies can reduce the probability of leakage, they still cannot fundamentally solve the leakage problem of the electronic cigarette.

SUMMARY

In order to solve the above problems, the present disclosure proposes an electromagnetically-driven liquid atomization device. The device of the present disclosure electromagnetically drives a liquid to form a convex thin liquid film or droplet, and enables the convex thin liquid film or droplet to contact a hot surface of an electrical heating element, so as to rapidly atomize the liquid film or droplet into an aerosol to be inhaled by an inhaler.

The present disclosure has the following technical solution:

An electromagnetically-driven liquid atomization device includes an atomizing core and an electromagnetic drive unit, where the atomizing core includes a liquid storage tank and an electrical heating element; the liquid storage tank is provided with a driving cavity and an extrusion cavity; the driving cavity and the extrusion cavity are in fluid communication; an upper wall of the driving cavity is provided with an elastic diaphragm and a permanent magnet; an upper end of the extrusion cavity is provided with an opening as a droplet releasing hole; the electrical heating element is provided above the droplet releasing hole, such that a surface of the electrical heating element and the droplet releasing hole are opposite and spaced apart by a certain distance; the liquid storage tank is filled with a liquid for vaporization.

The electromagnetic drive unit is provided at the bottom of the atomizing core. A magnetic field generated by the electromagnetic drive unit is able to penetrate the liquid storage tank and the liquid inside and be induced by the permanent magnet.

Preferably, the surface of the electrical heating element and a plane where the droplet releasing hole is located may be parallel and spaced apart by a distance of 100 μm to 2 mm.

Preferably, the droplet releasing hole may have an area of less than 3 mm×3 mm.

Preferably, an apparent contact angle of water on the surface of the electrical heating element may be less than 90°.

Preferably, the liquid storage tank may have a volume of 1-2 ml.

Preferably, the atomizing core may be further provided with a pressing plate, an upper sealing gasket, an extrusion cavity frame, a driving cavity body, a lower sealing gasket, a substrate and a base; the liquid storage tank may be enclosed by the driving cavity body, the elastic diaphragm, the upper sealing gasket, the lower sealing gasket and the substrate; the pressing plate may be provided on an outer wall of the elastic diaphragm; the permanent magnet may be provided between the pressing plate and the elastic diaphragm and may be attached to a wall of the elastic diaphragm; the extrusion cavity may be inside the extrusion cavity frame, and the opening of the extrusion cavity may be configured as the droplet releasing hole; the center of each of the pressing plate, the permanent magnet and the elastic diaphragm may be provided with a hole corresponding to the droplet releasing hole; the base may be provided at the bottom of the liquid storage tank;

the electromagnetic drive unit may be located in a cavity of an electromagnetic drive rod, and the atomizing core may be provided on an outer wall of the electromagnetic drive rod through the base.

Preferably, a power supply and a control chip may be further provided in the cavity of the electromagnetic drive rod; the electrical heating element may be electrically connected to the control chip and the power supply through a wire.

Preferably, the electromagnetically-driven single-droplet atomization device may further include a mouthpiece end cap; the mouthpiece end cap may be sleeved on a periphery of the atomizing core to form an atomizer; an air intake channel may be provided between a central bottom surface of the mouthpiece end cap and the electrical heating element to communicate with the outside. Air entering through the air intake channel is able to smoothly bring an aerosol generated on the surface of the electrical heating element into a mouthpiece to be inhaled by an inhaler.

Preferably, a liquid channel may be formed between the driving cavity and the extrusion cavity.

Preferably, the mouthpiece end cap may be internally provided with an aerosol releasing hole to communicate with the air intake channel; an observation window may be provided on a side wall of the mouthpiece end cap. The aerosol releasing hole is used to deliver an atomized liquid droplet into the mouthpiece of the inhaler.

The present disclosure has the following beneficial effects:

1. The present disclosure realizes quantitative liquid supply. Different from the method of passively siphoning the liquid to the heating element through a medium such as a liquid guiding cotton in the prior art, the present disclosure adopts an electromagnetic drive method for liquid supply, by which the amount of the liquid supplied for each puff is controllable. In addition, compared with the liquid supply method using a pumping mechanism in the prior art, the liquid supply device (liquid extrusion device) of the present disclosure is a part of the liquid storage tank. This design improves the integration level and avoids the problems caused by the use of the external pump, that is, the large overall volume and the complicated connection structure between the liquid storage tank and the pump.

2. The present disclosure solves the leakage problem. In the present disclosure, the volume of the liquid film or droplet extruded from the droplet releasing hole is very small, and the distance between the droplet releasing hole and the surface of the electrical heating element is very small (<2 mm, even only a few hundred microns). Besides, the liquid driving stroke in the extrusion cavity is short (such as <5 mm), and the heating of the electrical heating element is very fast (typically no more than hundreds of milliseconds). The liquid droplet or film extruded from the droplet releasing hole is atomized at the moment when its convex surface contacts with the surface of the electrical heating element, which increases the liquid film or droplet atomization efficiency. In addition, through the surface treatment of the electrical heating element, the wettability and spreading speed of the liquid droplet on the surface of the electrical heating element are improved, thereby accelerating the atomization. Therefore, the liquid will not remain on the surface of the electrical heating element during the atomization of the liquid film or droplet. While the liquid film or droplet is atomized upon contact, the remaining liquid on the outer edge of the droplet releasing hole will quickly flow back into the extrusion cavity, and the relaxation time is usually no more than hundreds of milliseconds to ensure that no liquid remains outside the droplet releasing hole after atomization. When the device is powered off or not in use, the liquid is in the form of column with a flat top surface, and it is usually adhered to the inner wall of the extrusion cavity and will not flow out of the droplet releasing hole. Therefore, the device of the present disclosure fundamentally solve the leakage problem that the leakproof structure and leakproof technology of the prior art cannot solve.

3. Compared with the piezoelectric drive in the prior art, the electromagnetic drive of the present disclosure solves the problem that the driving force is greatly reduced due to the difficult deformation of the piezoelectric element when the size of the device is reduced.

4. Compared with the large-volume liquid in the prior art, the electromagnetically-driven liquid in the present disclosure is a small-volume liquid droplet or film. The prior art adopts passive liquid-conducting electronic atomization. When any of the electrical heating elements, such as porous ceramic core, metal grid sheet, ultra-thin metal sheet and conventional electrical heating wire, is used for heating, the atomized liquid is in complete contact with the electrical heating element and is atomized in large volume. This decreases the electric heat conversion efficiency of the electrical heating element, and causes the non-uniform heating of the electrical heating element. In addition, compared with the traditional droplet atomization with uncontrollable liquid supply amount, the liquid droplet or film formation in the present disclosure is fast and controllable. Meanwhile, in the present disclosure, the atomization of the small-volume liquid droplet or film is surface contact atomization. The liquid film or droplet quickly wets and spreads on the surface of the electrical heating element to form a thin layer, which makes the heating more uniform. This atomization method avoids the adhesion of a large amount of liquid on the surface of the electrical heating element to cause local cooling and non-uniform surface temperature distribution, thereby preventing the problem of splashing of the liquid droplet.

5. The present disclosure has excellent sensory quality in addition to the above-mentioned advantages of no leakage and rapid and uniform atomization. In the present disclosure, the small volume of liquid on the surface of the electrical heating element is instantly atomized, and the surface temperature is adjusted to avoid the film boiling zone. This design eliminates the vapor film's barrier between the liquid and the surface of the electrical heating element, and also prevents the non-atomized liquid from remaining on the surface of the electrical heating element. Compared with the electronic cigarette atomization in the prior art, in the present disclosure, the air entering through the air intake channel quickly exchanges heat with the surface of the electrical heating element, and the heat-carrying vapor generated on the surface of the electrical heating element will be carried away by the air from the surface of the electrical heating element under the negative-pressure inhalation state. In addition, by adjusting the surface area and roughness of the electrical heating element and controlling the surface temperature of the electrical heating element to be in the nucleate boiling zone, the surface of the electrical heating element is rapidly cooled after the liquid droplet is atomized. Therefore, at the moment when the liquid droplet is atomized into an aerosol to be taken away by the air, the surface of the electrical heating element will quickly cool down. This will effectively avoid the problem of dry burning on the surface of the electrical heating element due to no new liquid contact after the liquid droplet is atomized. This also avoids the risk that the residual liquid outside the droplet releasing hole cannot be normally returned back into the extrusion cavity due to high temperature adhesion, causing the droplet releasing hole to be blocked. Therefore, the device of the present disclosure can avoid the generation of undesirable smells such as burnt smell.

6. The present disclosure also has other advantages. Due to the small liquid volume (1-2 mL) in the liquid storage tank of the present disclosure, the distance between the permanent magnet and the electromagnetic drive unit is very short (no more than 5 mm). Only a low-power electromagnetic drive device can generate a sufficient magnetic force to drive the small-volume liquid, and the electromagnetic drive unit has low power consumption. While the magnetic drive is satisfied to produce a stable and small-volume liquid droplet or film, the reduction in the volume of the liquid in the liquid storage tank due to the continuous consumption of atomization, as well as the tilt angle for hand-holding the device and the size of the inhalation force will not significantly influence the formation of the liquid droplet or film, the size of the extruded liquid droplet or film and the atomization properties of the liquid droplet or film. The liquid storage tank of the present disclosure features high integration, simple structure, cheap and easy-to-obtain materials, and is more suitable for disposable, replaceable and portable atomizers. In addition, the device of the present disclosure is not limited to being used for electronic cigarettes, and can also be used for other applications where a vapor or aerosol product with a controllable dose is produced through the atomization of a small-volume liquid droplet or film.

Figure 1:
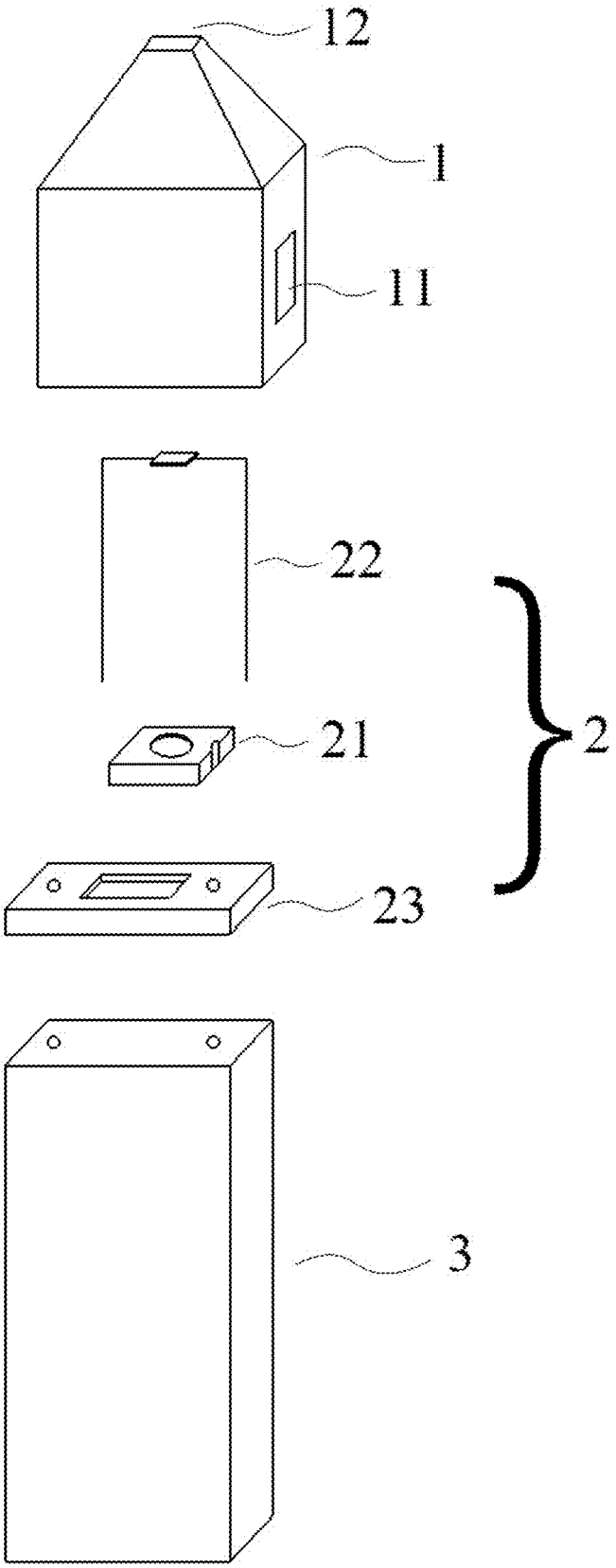
FIG. 1 is an exploded view of an electromagnetically-driven liquid atomization device according to the present disclosure.

Reference Numerals: 1. mouthpiece end cap; 10. air intake channel; 101. concave surface; 103. convex surface; 11. observation window; 12. aerosol releasing hole; 2. atomizing core; 200. liquid; 21. liquid storage tank; 211. driving cavity; 2110. liquid channel; 2111. elastic diaphragm; 2112. permanent magnet; 2113. pressing plate; 2114. upper sealing gasket; 2115. extrusion cavity frame; 2116. driving cavity body; 2117. lower sealing gasket; 2118. substrate; 212. extrusion cavity; 2121. droplet releasing hole; 22. electrical heating element; 221. surface of electrical heating element; 222. wire; 23. base; 3. electromagnetic drive rod; 31. electromagnetic drive unit; and 4. atomizer.

DETAILED DESCRIPTION OF THE EMBODIMENTS

The present disclosure is illustrated in further detail below with reference to the embodiments and accompanying drawings, which is intended to facilitate the understanding of the present disclosure, rather than to limit the present disclosure.

Figure 2:
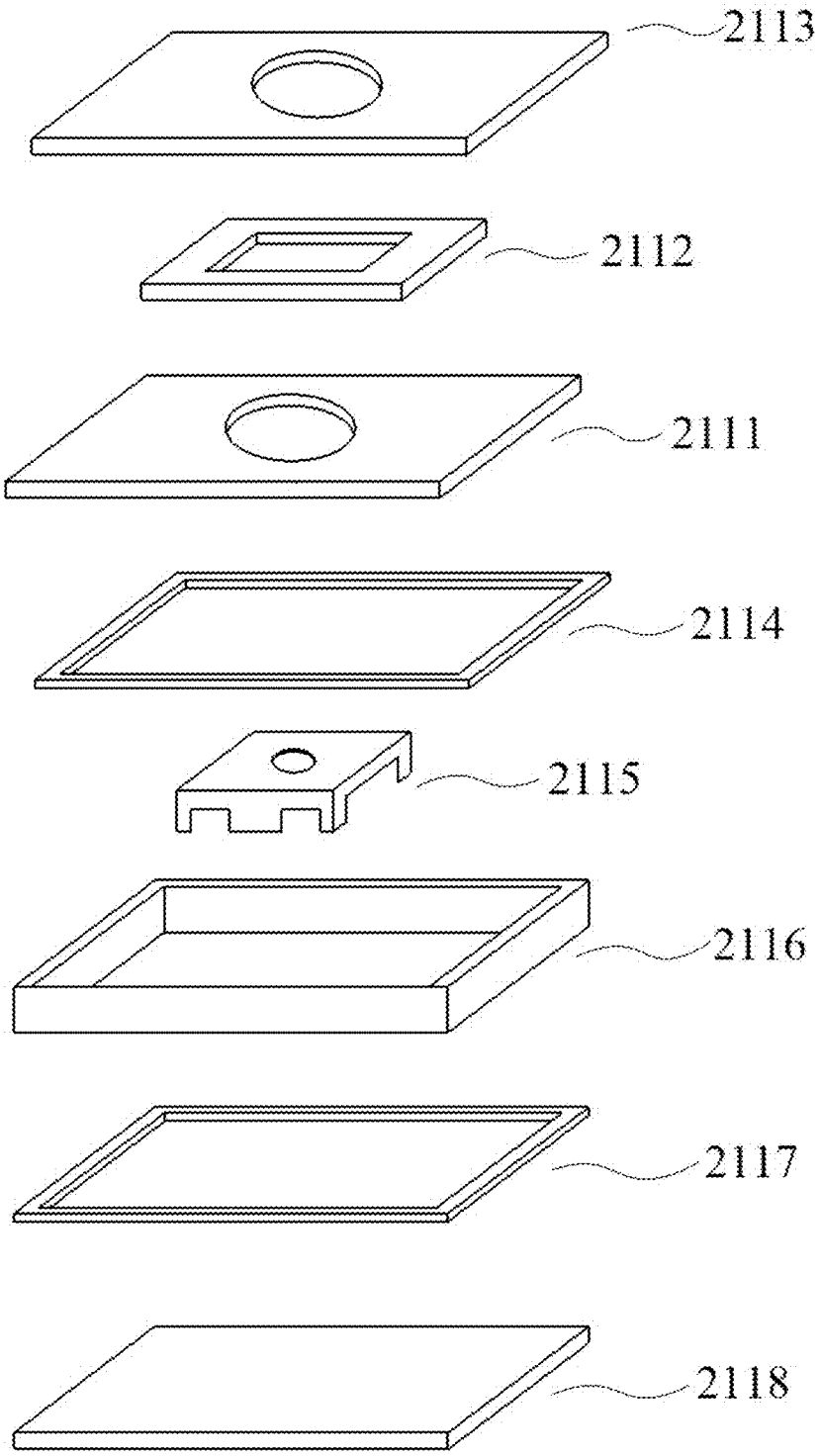
FIG. 2 is an exploded view of a liquid storage tank according to the present disclosure.
Figure 4:
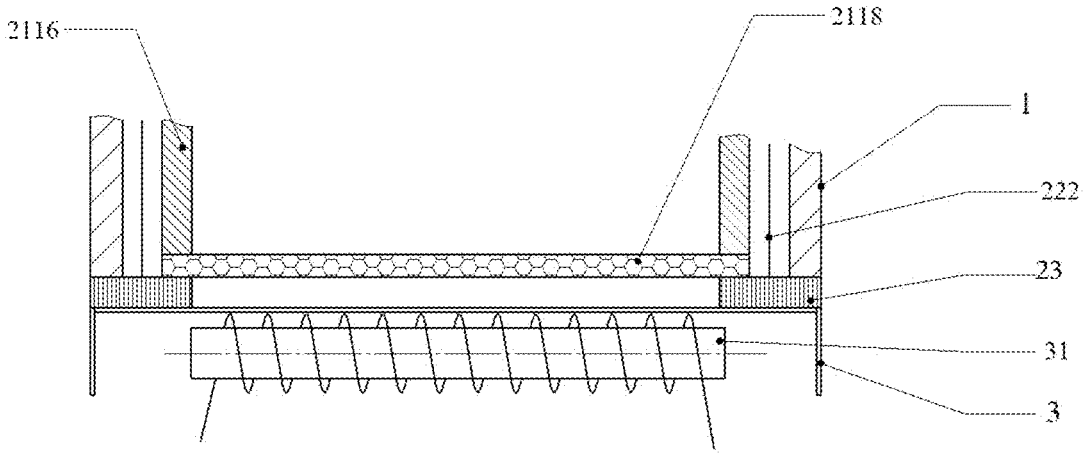
FIG. 4 is a cross-sectional view of the atomizer and an electromagnetic drive rod according to the present disclosure.
Figure 5:
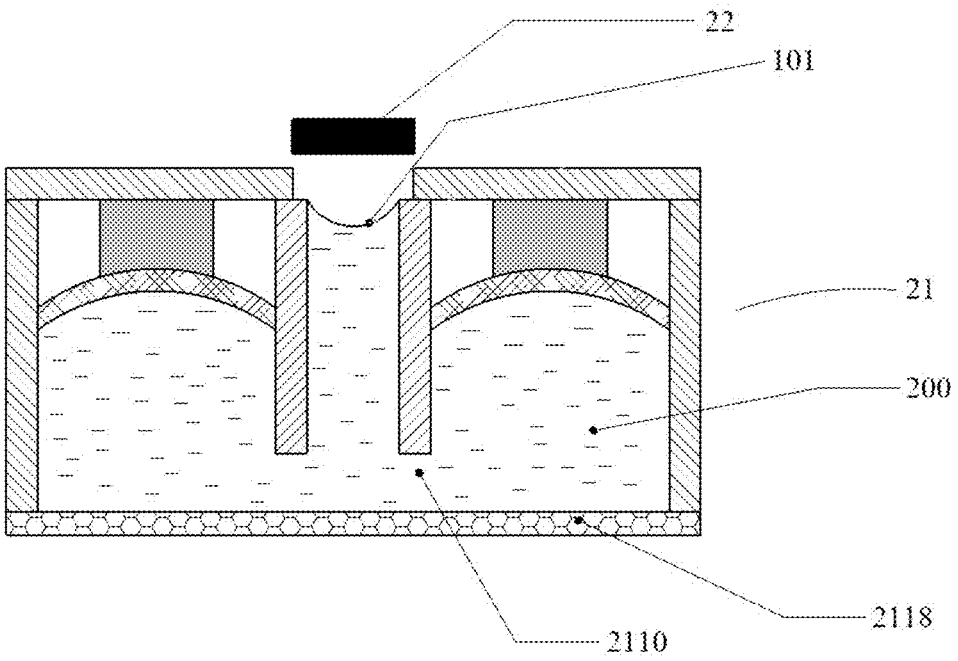
FIG. 5 shows a state of the liquid storage tank and a surface of an electrical heating element when a liquid surface in a droplet releasing hole is a concave surface according to the present disclosure.
Figure 6:
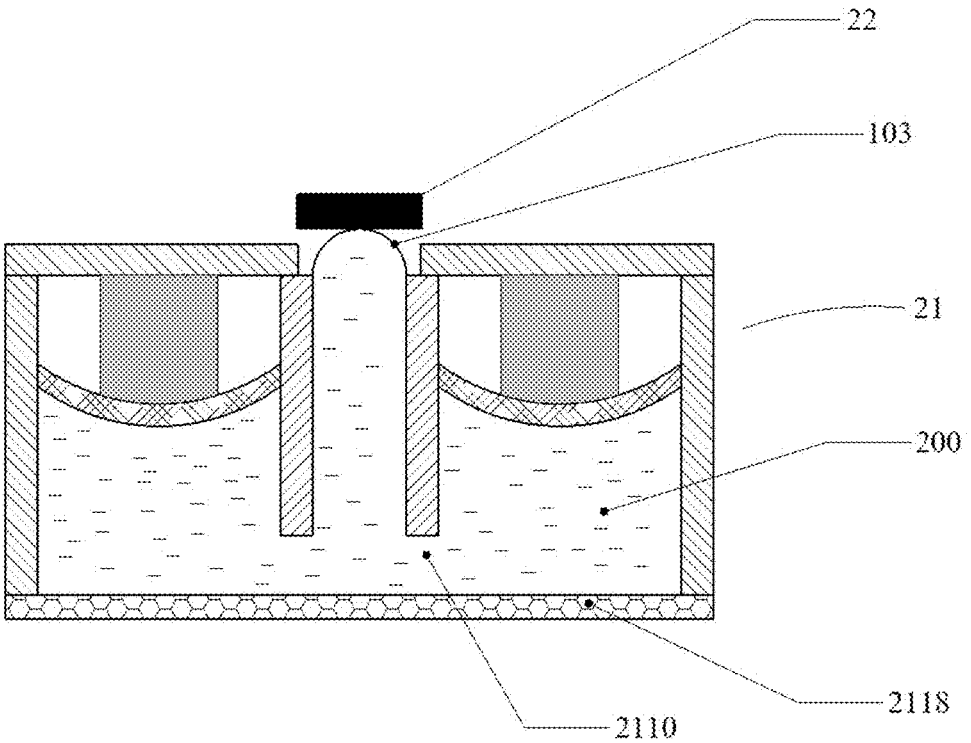
FIG. 6 shows a contact state between a convex liquid surface in the droplet releasing hole and the surface of the electrical heating element according to the present disclosure.

As shown in FIG. 1, an electromagnetically-driven single-droplet atomization device of the present disclosure includes a mouthpiece end cap 1, an atomizing core 2 and an electromagnetic drive rod 3 connected in sequence. The atomizing core 2 includes a liquid storage tank 21, an electrical heating element 22 and a base 23. As shown in FIG. 2, the liquid storage tank 21 is composed of a pressing plate 2113, a permanent magnet 2112, an elastic diaphragm 2111, an upper sealing gasket 2114, an extrusion cavity frame 2115, a driving cavity body 2116 and a lower sealing gasket 2117 and a substrate 2118 from top to bottom. In the present disclosure, the liquid storage tank has a volume of 1-2 mL. An extrusion cavity 212 is provided in the extrusion cavity frame 2115, and a driving cavity 211 is provided in the driving cavity body 2116. The driving cavity 211 and the extrusion cavity 212 are located inside the liquid storage tank 21 and communicate with each other through a liquid channel 2110. The electrical heating element 22, the liquid storage tank 21 and the base 23 together define the atomizing core 2. The electrical heating element 22 is provided above the droplet releasing hole 2121. A surface 221 of the electrical heating element faces the droplet releasing hole 2121 of the extrusion cavity 212. It is parallel to and keeps a certain distance from a surface of the droplet releasing hole 2121. The mouthpiece end cap 1 is sleeved on the outside of the atomizing core 2 to form an atomizer 4. The electromagnetic drive rod 3 includes a built-in electromagnetic drive unit 31, a power supply and a control chip. As shown in FIG. 4, the atomizing core 2 is provided on an outer wall of the electromagnetic drive rod 3 through the base 23. The atomizer 4 and the electromagnetic drive rod 3 define the electromagnetically-driven liquid atomization device of the present disclosure. The electromagnetic drive unit 31 in the device is energized to generate a magnetic field, which can penetrate the substrate 2118 and a to-be-atomized liquid 200 inside the liquid storage tank 21 and be induced by the permanent magnet 2112. The electrical heating element 22 is electrically connected to the control chip and the power supply through a wire 222. A distance between the surface 221 of the electrical heating element and the droplet releasing hole 2121 is 100 μm to 2 mm. An area of a central hole of each of the pressing plate 2113, the permanent magnet 2112 and the elastic diaphragm 2111 is larger than that of the droplet releasing hole 2121, and the area of the droplet releasing hole 2121 is smaller than 3 mm×3 mm. A contact area of the surface 221 of the electrical heating element with a liquid droplet is also less than 3 mm×3 mm.

Figure 3:
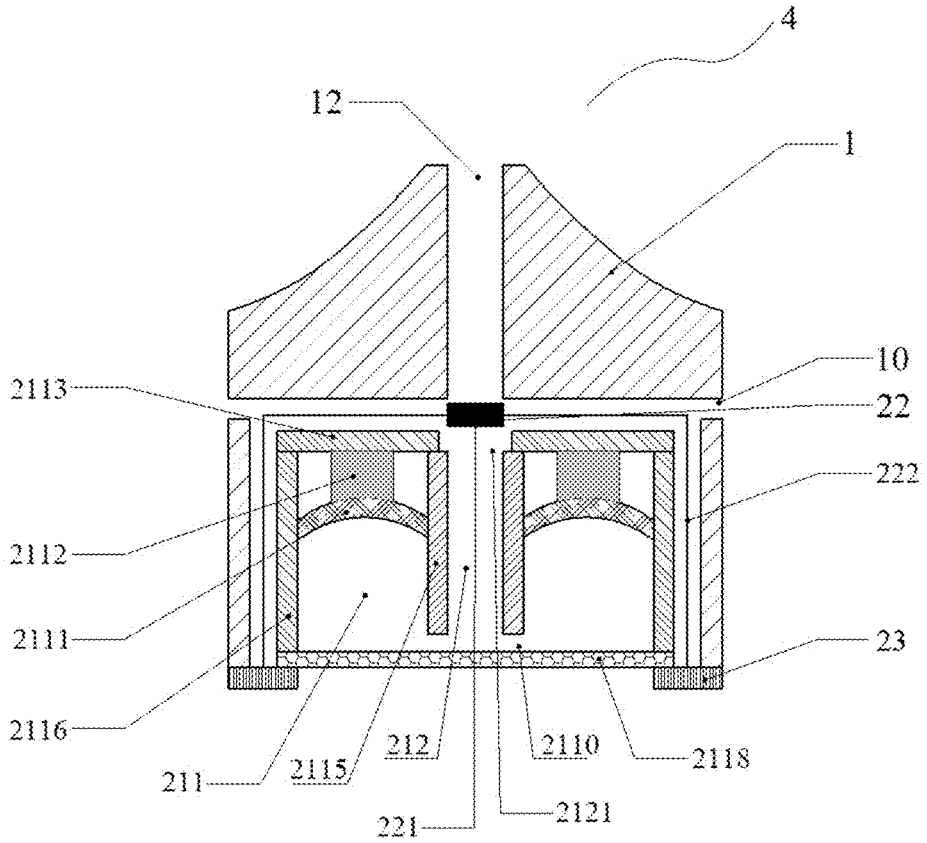
FIG. 3 is a cross-sectional view of an atomizer according to the present disclosure.

As shown in FIG. 3, an air intake channel 10 is provided between a central bottom surface of the mouthpiece end cap 1 and the electrical heating element 22 to communicate with the outside. The mouthpiece end cap 1 is internally provided with an aerosol releasing hole 12 to communicate with the air intake channel 10. An observation window 11 is provided on a side wall of the mouthpiece end cap 1. The mouthpiece end cap 1 is sleeved on a periphery of the atomizing core 2 to define the atomizer 4. By designing the air intake channel 10, when the aerosol generated by atomizing the liquid droplet is inhaled, air entering through the air intake channel 10 is able to smoothly bring the atomized vapor on the surface 221 of the electrical heating element into the aerosol releasing hole 12 for a mouthpiece of an inhaler to inhale.

The requirements for the components of the electromagnetically-driven single-droplet atomization device of the present disclosure are described as follows.

The permanent magnet 2112 may be a ring-shaped rubidium magnet, a ferrite magnet, an alnico permanent magnet or a samarium cobalt permanent magnet, etc. The elastic diaphragm 2111 may be made of a polysiloxane elastic material such as polydimethylsiloxane (PDMS) or a polyester elastic material such as polyurethane (PU). The upper sealing gasket 2114 and the lower sealing gasket 2117 may be made of a polyimide silicone material or a similar sealing material. The extrusion cavity frame 2115 may be made of a high-temperature resistant material such as polycarbonate (PC) and PC/acrylonitrile, butadiene and styrene (ABS). The driving cavity body 2116 may be made of PC, PC/ABS, ABS, polypropylene (PP), polyethylene (PE), polyvinyl chloride (PVC), polyamide (PA), polymethyl methacrylate (acrylic or PMMA), etc. The substrate 2118 may be made of a material that can penetrate the magnetic field, such as hard glass or transparent plastic (such as PC or PMMA).

As shown in FIG. 4, the electromagnetic drive unit 31 may be a miniaturized or micro-miniaturized electromagnetic coil, which can generate a sufficient magnetic force to move the permanent magnet 2112, thereby squeezing or stretching the elastic diaphragm 2111 to bend. A driving voltage needs to be applied to the electromagnetic drive unit 31 to generate the magnetic field, and an appropriate driving frequency is also needed to achieve a rapid response to the bending deformation of the elastic diaphragm 2111 with time. In addition, in order to achieve miniaturization of the drive device to save space, micro-electromechanical systems (MEMS) and other micro-manufacturing technologies can be used to manufacture an electromagnetic micro-coil or a planar non-helical micro-coil. In particular, the manufacturing process of the drive device can be simplified by reducing the total number of coils, and the total number of coil turns can be increased to reduce the size of the coil.

The electrical heating element 22 is a thin sheet structure. Taking into account the electrical heating efficiency, the workability of the sheet structure, the wettability and vaporization characteristics of the liquid droplet on the surface 221 of the electrical heating element and the miniaturization of the device, etc., the electrical heating element may vary with different surface characteristics and thermal properties, such as a porous or rough metal/alloy heating sheet, a metal/alloy grid heating sheet, a micro-nano porous metal/alloy felt, a porous ceramic heating sheet, a metal foil resistor, a metal electrical heating film, a smooth surface metal/alloy heating sheet, or a silicon-based heating chip manufactured by the MEMS technology.

The components of the electromagnetically-driven single-droplet atomization device of the present disclosure are assembled as follows.

(1) Assemble the Liquid Storage Tank 21 and Inject the Liquid:

First, the substrate 2118 and the driving cavity body 2116 as well as the extrusion cavity frame 2115 and the substrate 2118 are bonded together by the lower sealing gasket 2117 with a double-sided adhesive. The extrusion cavity frame 2115 is provided with a channel 2110 on a side for the liquid 200 in the driving cavity 211 and the extrusion cavity 212 to flow back and forth. The liquid 200 is injected into the driving cavity 211 until a liquid surface in the driving cavity 211 reaches a height where the liquid can completely contact an inner surface of the elastic diaphragm 2111, and the liquid in the extrusion cavity 212 reaches a certain height without overflowing from the droplet releasing hole 2121. Then the elastic diaphragm 2111 and the driving cavity body 2116 are bonded together by the upper sealing gasket 2114 with a double-sided adhesive.

After the bonding of the above components is completed, the permanent magnet 2112 is pressed on the elastic diaphragm 2111, and then the pressing plate 2113 is pressed on the permanent magnet 2112. So far, the assembly of the liquid storage tank 21 is completed.

(2) Assemble the Atomizing Core 2:

The assembled liquid storage tank 21 is fixed on the base 23, and the wire 222 of the electrical heating element 22 is clamped into a wire clamping groove in an outer wall of the driving cavity body 2116.

(3) Assemble the Electromagnetically-Driven Liquid Atomization Device:

The mouthpiece end cap 1 is sleeved outside the atomizing core 2, and its bottom is placed on the base 23 to form the atomizer 4. The atomizer 4 is connected to the outer wall of the electromagnetic drive rod 3 through the base 23 to form the electromagnetically-driven liquid atomization device of the present disclosure.

The working principle of the electromagnetically-driven single-droplet atomization device of the present disclosure is as follows:

Step 1: The liquid is electromagnetically-driven to produce a liquid film or droplet, and the liquid film or droplet is atomized.

After the electromagnetic drive rod 3 of the device of the present disclosure is connected to the atomizer 4 and the power supply is turned on, a driving voltage and a driving current of a certain waveform are applied to the electromagnetic drive unit 31. Meanwhile, the electrical heating element 22 undergoes electrothermal conversion, and the temperature rapidly rises. At this time, the electromagnetic drive unit 31 undergoes electromagnetic conversion to generate a magnetic field. The magnetic field penetrates the substrate 2118 at the bottom of the liquid storage tank 21 and the liquid 200 through a shell at a connection point of the electromagnetic drive rod 3 and the atomizer 4 to act on the permanent magnet 2112, such that the permanent magnet is attracted by the magnetic force.

The permanent magnet 2112 is moved toward the electromagnetic drive unit 31 under the action of the magnetic force and exerts a certain pressure on the elastic diaphragm 2111 below. Driven by this pressure, the elastic diaphragm 2111 is bent and deformed facing the driving cavity 211, such that the elastic diaphragm 2111 generates a pressure driving effect on the liquid 200 in the driving cavity 211. The liquid 200 in the driving cavity 211 flows into the extrusion cavity 212 through the channel 2110 in the liquid storage tank 21, and further drives the liquid in the extrusion cavity 212 to move in the direction of the droplet releasing hole 2121.

As the driving voltage and the driving current continue to increase, when the liquid in the extrusion cavity 212 continues to move toward the droplet releasing hole 2121, the shape of the liquid surface transitions from a concave surface 101 to a flat surface and approaches an opening of the droplet releasing hole 2121. When the driving voltage and the driving current increase to a certain maximum value, the liquid surface along an inner edge of the opening of the droplet releasing hole 2121 is squeezed out of the opening of the droplet releasing hole 2121, and a liquid film or droplet with a convex surface 103 is generated between the droplet releasing hole 2121 and the surface 221 of the electrical heating element 22. After the convex surface 103 is in contact with the high-temperature surface 221 of the electrical heating element, under the action of the surface tension and capillary force, the liquid film or droplet exposed to the droplet releasing hole 2121 overcomes its own gravity and the adhesion force of the droplet releasing hole 2121 to wet and spreads quickly on the surface 221 of the electrical heating element and to be quickly atomized. The aerosol generated by the atomization is brought into the aerosol releasing hole 12 of the mouthpiece end cap 1 by the air inhaled in through the air intake channel 10 and is inhaled by the inhaler.

Step 2: Electromagnetic relaxation occurs to eliminate the liquid film or droplet, and electromagnetic action stops.

Figure 7:
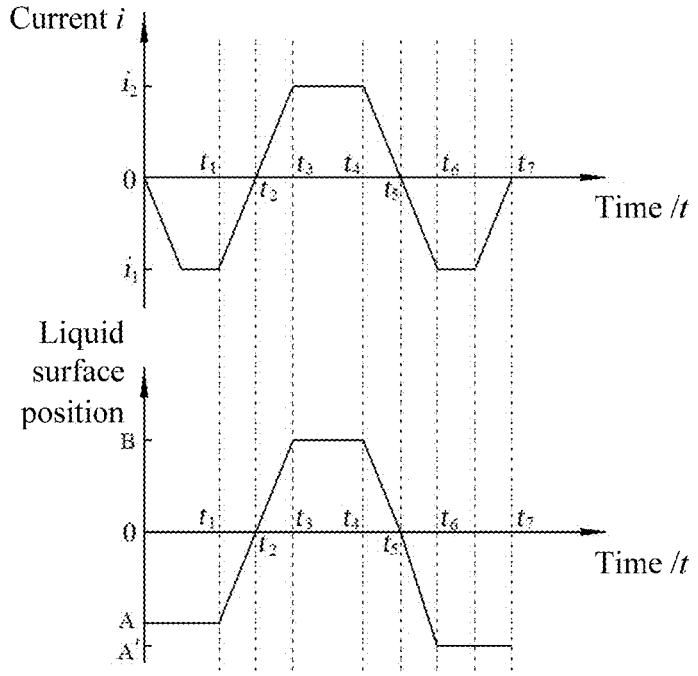
FIG. 7 shows a time-dependent current graph (upper) and a time-dependent liquid surface position graph (lower) according to the present disclosure.
Figure 8:
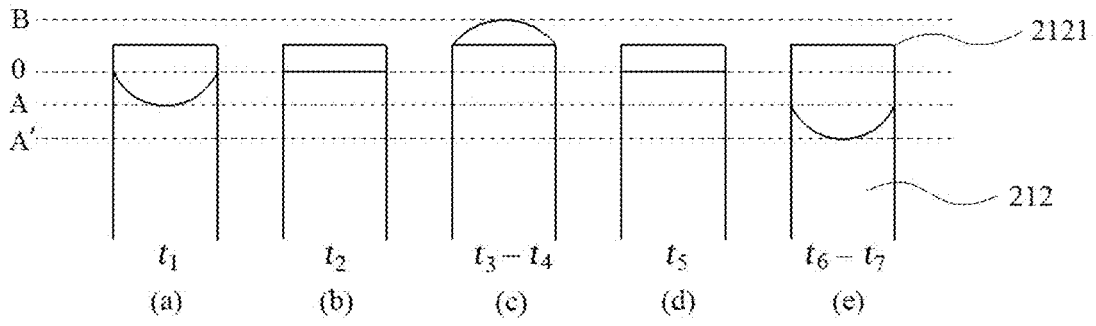
FIG. 8 shows liquid surface shapes and positions at various time periods in a liquid droplet or film formation cycle according to the present disclosure.

When the liquid film or droplet is rapidly atomized on the surface of the electrical heating element, the driving voltage is reduced, and the size and direction of the driving current are changed synchronously. Relaxation occurs. The liquid remaining outside the opening or at the inner edge of the opening of the droplet releasing hole 2121 after atomization retracts into the extrusion cavity 212. The shape of the liquid surface changes rapidly from a convex surface to a flat surface and then to a concave surface. The liquid in the extrusion cavity 212 further moves to the bottom. When the driving current reaches a certain reverse maximum value, the liquid in the extrusion cavity 212 stops moving and maintains the shape of the liquid surface as a concave surface. Further, when the driving voltage and the driving current become zero, the electromagnetic drive unit 31 stops working, the liquid surface in the extrusion cavity 212 is stabilized at a certain position and the shape of the liquid surface remains flat. The above process is shown in FIGS. 7 and 8.

Drive Parameters and Time Control:

The length of the liquid film or droplet formation cycle, the duration of each inhalation and the relationship between the liquid film or droplet formation cycle and the duration of each inhalation are set. The driving of the liquid in the extrusion cavity, the formation of the liquid film or droplet outside the extrusion cavity and the atomization of the liquid film or droplet in contact with the surface of the electrical heating element are synchronized with each inhalation. In addition, in case the duration of each inhalation exceeds the length of the liquid film or droplet formation cycle, the duration of the inhalation is too short, the inhalation is suddenly stopped or the power supply is insufficient, the device automatically cuts off the electrical connection, the driving voltage and the driving current are immediately returned to zero, and the electromagnetic drive unit 31 stops working. Due to the instantaneous disappearance of the magnetic field and the magnetic force, the position and shape of the liquid surface in the extrusion cavity 212 immediately return to the initial position and flat shape within the liquid film or droplet formation cycle.

In the present disclosure, the liquid film and the liquid droplet are defined as follows. When the vertical distance between the highest point of the convex liquid surface at the opening of the droplet releasing hole 2121 and the plane where the opening of the droplet releasing hole 2121 is located, that is, the height of the convex liquid surface, is low, the liquid surface is defined as a "liquid film". When the height of the convex liquid surface is high, the liquid surface is defined as a "liquid droplet". These two situations are collectively referred to as "liquid film or droplet". In the present disclosure, "liquid film", "liquid droplet" or "liquid film or droplet" collectively refer to the state of the liquid at the droplet releasing hole 2121.

The factors and parameters affecting the formation of the liquid droplet and the control strategies in the present disclosure are specifically described as follows.

The factors affecting the formation of the liquid droplet include the geometric size of the droplet releasing hole 2121, the material properties of the extrusion cavity body and the droplet releasing hole 2121, the properties of the extruded liquid 200, driving conditions, etc. It is necessary to consider the material wettability and surface tension of the extrusion cavity 212 and the droplet releasing hole 2121 that play an important role in the droplet formation process. The inner wall of the entire extrusion cavity 212 and the inner wall of the droplet releasing hole 2121 directly contact the liquid, so the wettability has a significant influence on the adhesion. In the present disclosure, the inner wall of the extrusion cavity 212 and the droplet releasing hole 2121 are preferably hydrophilic (for example, with a contact angle <60°) and strongly adhesive to the liquid. Thus, the liquid meniscus is a concave surface with a higher curvature, and the concave shape of the liquid surface is more stable in the extrusion cavity. In addition, the liquid droplet can be prevented from trailing at the hydrophobic droplet releasing hole 2121 to cause the extruded liquid droplet to adhere to the droplet releasing hole 2121. The adhesion of the liquid will slow down the extrusion rate of the liquid droplet and cause some liquid to remain outside the droplet releasing hole 2121, resulting in a decrease in the atomization rate and affecting the atomization quality of the liquid droplet. In addition, the surface tension of the liquid significantly affects the formation and change of the liquid droplet. By increasing the surface tension of the liquid droplet, when the liquid droplet outside the opening of the droplet releasing hole 2121 is atomized, the liquid surface adhered outside or inside the inner edge of the opening of the droplet releasing hole 2121 quickly retracts into the extrusion cavity. In this way, the liquid is prevented from remaining outside or inside the opening of the droplet releasing hole 2121, and the formation rate of the liquid droplet is increased. Meanwhile, the liquid is prevented from remaining and adhering at the droplet releasing hole, thereby preventing liquid leakage and high-temperature solidification to block the droplet releasing hole 2121, and ensuring the consistency of the atomization effect of each liquid droplet and each inhalation. These two aspects ensure that the liquid is stabilized in the extrusion cavity without overflowing before the liquid droplet is formed, and also ensure that the liquid does not remain in the droplet releasing hole 2121 after the extruded liquid droplet is driven to atomize, thereby preventing the risk of liquid leakage from the inside of the extrusion cavity 212 at any time. When the wettability and surface tension of the liquid are determined, a suitable liquid viscosity is needed to ensure that the liquid droplet is extruded from the extrusion cavity at a suitable speed and volume.

The driving mode of the liquid in the liquid storage tank 21 determines the droplet formation process and the change of the liquid surface shape. The input current and driving voltage of the electromagnetic drive device are essential for driving the liquid to move quickly and stably in the extrusion cavity 212 and to form a liquid droplet of the required size and shape.

The input current parameters that control the formation of the liquid droplet include the waveform and amplitude of the input current and the width of the electrical pulse. The waveform of the input current is an important and key indicator for the formation of the liquid droplet by electromagnetic drive. The waveform of the driving current in the present disclosure may be a sine wave current, a triangle wave current or a square wave current. Preferentially, the required bidirectional current is obtained through a square wave current and an adjustable frequency, and the change of the electromagnetic polarity is achieved through the change of the current direction, so as to control the driving process of the liquid, the change of the liquid surface shape and the formation of the liquid droplet. It is necessary to establish a time-dependent current graph. It is intended to ensure a very short time interval between the steps of liquid driving, droplet formation and droplet atomization. It is also intended to carry out precise electrical control of the above steps within a specified time period, so as to ensure the position and shape of the liquid surface and the stability and consistency of the formation of the liquid droplet. It includes the stages of driving the liquid to move in the extrusion cavity 212, extruding and stabilizing the liquid droplet at the droplet releasing hole 2121, enabling the liquid surface at the droplet releasing hole 2121 to retract into the extrusion cavity 212, etc. It realizes a single droplet formation cycle, and achieves the time coordination between the amplitude and direction of the input current, the change of the liquid surface position and the change of the liquid surface shape.

The specific implementation is as follows:

As shown in FIG. 7, the time-dependent current graph and time-dependent liquid surface position graph in the single droplet formation cycle are divided into five stages (stages I to V), and the corresponding liquid surface shapes and positions are shown in FIG. 8.

Stage I: Liquid drive preparation. A driving current is applied to the electromagnetic drive unit 31, and the current changes from 0 to a certain negative value $i_1$ and stabilizes at this value. The magnetic force received by the permanent magnet 2112 is a repulsive force. The elastic diaphragm 2111 bends outside the driving cavity 211, such that the liquid surface in the extrusion cavity 212 is at a certain position A and maintains a concave shape with the largest curvature (FIG. 8-*a*), corresponding to a time period of $0–t_1$.

Stage II: Liquid drive and droplet formation. The driving voltage increases, and the electrical heating element 22 rapidly heats up. The direction of the driving current gradually changes from negative to positive, and the magnetic force received by the permanent magnet 2112 quickly changes from repulsive to attractive. Under the squeezing action of the permanent magnet, the elastic diaphragm 2111 quickly bends into the driving cavity 211, and the liquid in the extrusion cavity 212 is driven by the pressure to move to the droplet releasing hole 2121. The movement stroke of the liquid surface in the extrusion cavity 212 is divided into two steps. In a first step, the driving current changes from the negative value $i_1$ to 0, and the liquid surface moves from position A to the inner edge of the droplet releasing hole (position 0), corresponding to a time period of $t_1–t_2$, and the shape of the liquid surface changes from a concave surface at position A to a flat surface at position 0 (FIG. 8-*b*). In a second step, the driving current is further increased from 0 to a positive value $i_2$, and the liquid surface moves from the inner edge of the droplet releasing hole (position 0) to a certain position B on the outer edge of the droplet releasing hole, corresponding to a time period of $t_2–t_3$, and the shape of the liquid surface changes from the flat surface at position 0 to a convex surface at position B. At this time, a convex droplet is formed on the outer edge of the droplet releasing hole 2121 and directly contacts the surface 221 of the electrical heating element.

Stage III: Liquid droplet atomization. The driving voltage remains constant and the current remains at the maximum value $i_2$. The magnetic force received by the permanent magnet 2112 is attractive and the largest, and the bending curvature of the elastic diaphragm 2111 into the driving cavity 211 is the largest. The liquid droplet extruded from the droplet releasing hole 2121 wets and spreads on the surface 221 of the electrical heating element, and is separated (pinched off) from the liquid in the extrusion cavity and rapidly atomized, corresponding to a time period of $t_3–t_4$ (FIG. 8-*c*).

Stage IV: Liquid reverse driving and retraction. In a first step, the driving current changes from $i_2$ to 0, and the liquid surface moves from position B to the inner edge of the droplet releasing hole (position 0), corresponding to a time period of $t_4–t_5$, and the shape of the liquid surface changes from the convex surface at position B to the flat surface at position 0 (FIG. 8-*d*). In a second step, the driving current is further reduced from 0 to the negative $i_1$, and the shape of the liquid surface becomes concave; the driving current is stable at $i_1$ for a period of time, and the shape of the liquid surface remains concave (FIG. 8-*e*), corresponding to a time period of $t_6–t_7$.

(Note: In an ideal case when the electromagnetic driving force is large enough and the length of the extrusion cavity is short enough, it is approximately considered that the change of the liquid surface between the initial position A and return position A' in the extrusion cavity in each cycle will not affect the droplet formation and the droplet state).

Stage V: Liquid stabilization and driving stop. The electrical connection of the electromagnetic drive device is disconnected, the driving current becomes 0, the states of the permanent magnet 2112 and the elastic diaphragm 2111 remain unchanged, and the liquid surface in the extrusion cavity 212 changes to a flat surface at position 0 (FIG. 8-*b* or 8-*d*). The inhalation is over.

In each single droplet formation cycle, as the extruded droplet is atomized, the liquid surface in the driving cavity 211 and the extrusion cavity 212 gradually drops. Within the specified number of inhalations and in the process of inhaling one by one, the driving voltage, the input current amplitude, the electromagnetic driving frequency, the electromagnetic pulse width (time) and other parameters in each single droplet formation cycle need to be optimized synchronously and changed in a gradient manner. In this way, as the liquid in the liquid storage tank 21 is consumed droplet by droplet, the movement state of the liquid in the extrusion cavity, the change of the liquid surface shape, the formation rate of the liquid droplet, the liquid surface retraction rate, the height of the extruded liquid droplet and the atomization state of the liquid on the surface of the electrical heating element 221 remain constant in each single droplet formation cycle. The small liquid volume (such as 1-2 mL) and the small size of the liquid storage tank 21 are designed to minimize the influences of the liquid volume and the size of the liquid storage tank 21 on the droplet formation and atomization. The elastic diaphragm 2111 has a suitable elastic modulus adapted to the electromagnetic driving frequency, which ensures that the liquid surface in the driving cavity 211 maintains complete contact with the inner wall surface of the elastic diaphragm 2111 during each single droplet formation cycle.

In addition to the time-dependent current graph for the liquid drive and droplet formation stage, it is also necessary to consider the synergy between the liquid drive and droplet formation time and the aerosol inhalation time. The electromagnetic drive unit 31 and the electrical heating element 22 are triggered by a button or an inhalation action to be synchronously connected with the power supply. When the electromagnetic drive is activated to squeeze the liquid 200 to move from the extrusion cavity 212 to the droplet releasing hole 2121, the electrical heating element 22 is synchronized to rapidly heat. When the convex surface of the droplet extruded at the droplet releasing hole 2121 directly contacts the surface 221 of the electrical heating element, the liquid droplet is rapidly atomized on the surface 221 of the electrical heating element and is inhaled by the inhaler. Specifically, when the heating rate of the electrical heating element 22 is greater than or equal to the electromagnetically-driven droplet formation rate, once the liquid droplet is formed and contacts the heating surface, it is atomized immediately. Alternatively, the effective single inhalation duration is set to be equal to the single droplet formation cycle. When the duration of the aerosol inhalation exceeds the single droplet formation cycle, the entire device automatically enters a power-off protection state. The electromagnetic drive unit 31 and the electrical heating element 22 stop working to avoid the problems of idling and dry burning of the electrical heating element due to no droplet formation beyond a single droplet formation cycle.

In the present disclosure, the factors and parameters affecting the evaporation and atomization of the liquid droplet are described in detail as follows.

The viscosity and surface tension of the liquid must be appropriate to ensure that the liquid droplet can be extruded from the extrusion cavity 212 at an appropriate speed and volume. In addition, the influences of the surface tension and viscosity of the liquid and the surface wettability of the electrical heating element on the spreading and retraction of the liquid droplet on the surface 221 of the electrical heating element should also be considered comprehensively. A high viscosity of the liquid will inhibit the spreading and retraction of the liquid on the surface. However, in the present disclosure, when the liquid droplet is in contact with the high-temperature surface, the surface tension and viscosity of the liquid droplet are greatly reduced at the moment of contact with the heating surface, thus promoting the spreading and retraction of the liquid droplet on the surface, without affecting the atomization efficiency of the high-viscosity droplet.

In the present disclosure, the distance between the droplet releasing hole 2121 and the surface 221 of the electrical heating element and the area of the droplet releasing hole are two important parameters that affect the amount of atomization and the amount of aerosol inhalation. (1) When the driving pressure and liquid properties are constant, if the distance between the droplet releasing hole and the surface of the electrical heating element is constant, as the diameter of the droplet releasing hole 2121 decreases, the extrusion resistance of the liquid at the droplet releasing hole 2121 of the extrusion cavity 212 increases, and the contact time between the extruded droplet and the surface 221 of the electrical heating element is prolonged. Meanwhile, the radius of the extruded droplet and the contact surface area with the surface 221 of the electrical heating element are reduced, and the spreading diameter of the liquid droplet on the surface is reduced, resulting in a reduction in the amount of atomization and a slower rate of atomization. Therefore, in the present disclosure, it is preferable that the droplet releasing hole 2121 and the surface 221 of the electrical heating element have a close surface area. In this way, the extruded liquid surface and the surface of the electrical heating element can quickly contact, and the liquid droplet can wet quickly on the surface of the electrical heating element to obtain the maximum spreading diameter, thereby achieving rapid atomization of the liquid droplet and full utilization of the electrical heating efficiency of the surface 221 of the electrical heating element. (2) When the driving pressure and liquid properties are constant, if the area of the droplet releasing hole 2121 is constant, as the distance between the droplet releasing hole 2121 and the surface 221 of the electrical heating element increases, the height of the extruded droplet increases, and the contact time between the liquid droplet and the surface of the electrical heating element prolongs, which may prolong the atomization time. With the prolongation of the contact time, the mass of the droplet in contact with the surface 221 of the electrical heating element increases, which may increase the amount of atomization. However, the cooling effect of the large mass of the liquid droplet on the surface 221 of the electrical heating element may cause non-uniform heating of the surface of the electrical heating element, resulting in a decrease in the amount of atomization. Therefore, it is necessary to strike a balance between the atomization rate and the amount of atomization.

In short, the electrical heating properties of the material of the electrical heating element, the surface area of the electrical heating element, the size of the droplet releasing hole 2121 and the distance between the droplet releasing hole and the surface 221 of the electrical heating element must be appropriate. In this way, the convex surface 103 of the extruded liquid droplet can quickly contact the surface 221 of the electrical heating element, spread and wet quickly on the surface 221 of the electrical heating element, and be quickly uniformly atomized, so as to achieve a suitable atomization amount and aerosol inhalation amount. Preferably, in the present disclosure, the distance between the droplet releasing hole 2121 and the surface of the electrical heating element is 100 μm to 2 mm, such that a single thin liquid film or droplet with a convex surface 103 in a corresponding height is formed between the droplet releasing hole 2121 and the surface of the electrical heating element. The area of the droplet releasing hole 2121 does not exceed 3 mm×3 mm, and the area of the surface 221 of the electrical heating element contacting the droplet does not exceed 3 mm×3 mm, either.

In the present disclosure, the distance between the convex surface 103 of the liquid and the surface 221 of the electrical heating element is small, and the length of the extrusion cavity 212 is short. Different from the rapid impact of a droplet on the surface, with a typical impact rate on the order of m/s, the velocity of the droplet in contact with the surface 221 of the electrical heating element in the present disclosure is smaller, with a typical contact rate on the order of mm/s. It greatly slows down the impact of the liquid droplet on the surface 221 of the electrical heating element, avoids violent evaporation of the liquid droplet, and minimizes the influence of the extrusion rate on the temperature of the surface 221 of the electrical heating element. Therefore, the droplet driving/extrusion rate and the contact angle between the liquid droplet and the surface 221 of the electrical heating element will not significantly affect the formation and atomization of the liquid droplet.

In the present disclosure, the thermal properties and surface characteristics of the material of the electrical heating element 22 have the greatest influence on the atomization characteristics of the liquid droplet. The thermal properties include thermal conductivity, heat capacity and oxidation of the heating surface. A material with high thermal conductivity can accelerate the spreading speed of the liquid droplet on the surface 221 of the electrical heating element. In order that the droplet is completely evaporated during the spreading stage, the temperature of the surface 221 of the electrical heating element can be increased to increase the heat transfer rate, thereby shortening the droplet-solid contact time. If the surface of the electrical heating element is not easily oxidized, it can also increase the spreading diameter of the liquid droplet and shorten the contact time between the liquid droplet and the surface 221 of the electrical heating element. The boiling heat transfer of the droplet can be promoted by changing the surface characteristics of the electrical heating element, such as the surface roughness, the micro-nano structure and the surface wettability. A heating surface with high wettability, that is, high hydrophilicity (for example, apparent contact angle <90°) can increase the Leidenfrost temperature and prevent the formation of a stable vapor film between the liquid droplet and the surface 221 of the electrical heating element. The vapor film of small thermal conductivity can block the droplet from the surface 221 of the electrical heating element and decrease the droplet evaporation rate. Meanwhile, by enhancing the wettability of the surface 221 of the electrical heating element, the spreading diameter of the liquid droplet on the surface 221 of the electrical heating element can be increased to make the droplet spread more easily, thereby shortening the contact time between the liquid droplet and the surface 221 of the electrical heating element. A porous surface 221 of the electrical heating element can increase the porosity, thereby increasing the surface roughness, such that the vapor formed between the liquid droplet and the surface 221 of the electrical heating element can penetrate into the pores. In this way, it releases the pressure generated when the vapor escapes the surface, increases the Leidenfrost temperature, and delays or completely prevents the film boiling of the liquid droplet on the surface 221 of the electrical heating element. Due to the increased porosity, the actual surface area of the pores in contact with the liquid is reduced, and air and vapor are trapped in the pores on the surface 221 of the electrical heating element, resulting in a decrease in the heat transfer efficiency. Therefore, it is necessary to ensure a suitable temperature at the surface 221 of the electrical heating element so as to increase the heat transfer coefficient. In addition, in the present disclosure, the contact between the liquid droplet and the surface 221 of the electrical heating element is slow contact. The liquid droplet does not penetrate into the surface pores at a high enough speed during the contact process, but it can spread on the surface to form a film and be sucked into the porous surface under the action of capillary force. The surface 221 of the electrical heating element can adopt a micro-nano structure such as a nano-texture or a nano-fiber structure to improve the contact between the liquid droplet and the surface 221 of the electrical heating element. In this way, when the liquid surface spreads on the surface 221 of the electrical heating element, the liquid droplet will not retreat or bounce, which is beneficial to the complete evaporation of the droplet in the micro-nano structure. When the electrical heating element adopts a surface 221 with high thermal conductivity, high surface wettability and high porous permeability, the temperature of the surface 221 of the electrical heating element is a very critical parameter. The surface temperature of the electrical heating element should be lower than the Leidenfrost temperature to avoid the film boiling of the liquid droplet. The film boiling of the droplet will greatly increase the evaporation time of the liquid droplet, resulting in a decrease in the evaporation rate. In addition, the surface temperature of the electrical heating element should fall within the nucleate boiling zone as much as possible. In this zone, the droplet has larger solid-liquid contact area, wettability and surface roughness, which promotes nucleate boiling, minimizes the evaporation time, and can achieve quick atomization. Meanwhile, the evaporation time of the liquid droplet changes little with the increase of the surface temperature, and the liquid droplet maintains a constant evaporation state, which can achieve uniform atomization.

The influence of the air on the evaporation and atomization of the liquid droplet contacting the surface 221 of the electrical heating element is mainly manifested in two aspects. First, when the air flow rate on the heating surface increases, the wetting area of the liquid droplet increases, the height of the liquid droplet decreases, and the evaporation time is shortened. Second, when the atomized aerosol is inhaled, a certain negative pressure is formed on the heating surface, which increases the diffusion coefficient of the atomized vapor and increases the evaporation rate of the liquid droplet. Therefore, the design of the air intake channel 10 of the mouthpiece end cap 1 and the negative pressure state are beneficial to the rapid atomization of the liquid droplet.

In summary, the electrical heating element of the present disclosure can adopt a material such as metal, alloy or silicon with high thermal conductivity and high surface temperature, and can further adopt a surface material or a modified surface material with a high wettability (that is, a small contact angle) to atomize the liquid droplet. In addition, the electrical heating element can adopt a mesh-like, fibrous metal or alloy with a porous or micro-nano structure to provide a high surface roughness, or a silicon-based heating chip with a patterned micro-structure on the surface. Meanwhile, the surface temperature should be lower than the Leidenfrost temperature and fall within the nucleate boiling zone.

The above described are merely specific implementations of the present disclosure, and the protection scope of the present disclosure is not limited thereto. Any modification or replacement easily conceived by those skilled in the art within the technical scope of the present disclosure should fall within the protection scope of the present disclosure. Therefore, the protection scope of the present disclosure should be subject to the protection scope of the claims.

What is claimed is:

1. An electromagnetically-driven liquid atomization device, comprising an atomizing core and an electromagnetic drive unit, wherein the atomizing core comprises a liquid storage tank and an electrical heating element;

the liquid storage tank is provided with a driving cavity and an extrusion cavity;

the driving cavity and the extrusion cavity are in fluid communication;

an upper wall of the driving cavity is provided with an elastic diaphragm and a permanent magnet;

an upper end of the extrusion cavity is provided with an opening as a droplet releasing hole;

the electrical heating element is provided above the droplet releasing hole, and a surface of the electrical heating element and the droplet releasing hole are opposite and spaced apart by a distance;

the electromagnetic drive unit is provided at a bottom of the atomizing core;

the atomizing core is further provided with a pressing plate, an upper sealing gasket, an extrusion cavity frame, a driving cavity body, a lower sealing gasket, a substrate and a base; wherein the liquid storage tank is enclosed by the driving cavity body, the elastic diaphragm, the upper sealing gasket, the lower sealing gasket and the substrate;

the pressing plate is provided on an outer wall of the elastic diaphragm;

the permanent magnet is provided between the pressing plate and the elastic diaphragm and the permanent magnet is attached to a wall of the elastic diaphragm;

the extrusion cavity is inside the extrusion cavity frame, and the opening of the extrusion cavity is configured as the droplet releasing hole;

a center of each of the pressing plate, the permanent magnet and the elastic diaphragm is provided with a hole corresponding to the droplet releasing hole;

the base is provided at a bottom of the liquid storage tank;

the electromagnetic drive unit is located in a cavity of an electromagnetic drive rod, and the atomizing core is provided on an outer wall of the electromagnetic drive rod through the base.

2. The electromagnetically-driven liquid atomization device according to claim 1, wherein the surface of the electrical heating element and a plane are parallel and spaced apart by a distance of 100 μm to 2 mm, wherein the droplet releasing hole is located in the plane.

3. The electromagnetically-driven liquid atomization device according to claim 1, wherein the droplet releasing hole has an area of less than 3 mm×3 mm.

4. The electromagnetically-driven liquid atomization device according to claim 1, wherein an apparent contact angle of water on the surface of the electrical heating element is less than 90°.

5. The electromagnetically-driven liquid atomization device according to claim 1, wherein the liquid storage tank has a volume of 1-2 ml.

6. The electromagnetically-driven liquid atomization device according to claim 1, wherein a power supply and a control chip are further provided in the cavity of the electromagnetic drive rod; and the electrical heating element is electrically connected to the control chip and the power supply through a wire.

7. The electromagnetically-driven liquid atomization device according to claim 1, further comprising a mouthpiece end cap; wherein the mouthpiece end cap is sleeved on a periphery of the atomizing core to form an atomizer;

an air intake channel is provided between a central bottom surface of the mouthpiece end cap and the electrical heating element to communicate with an outside.

8. The electromagnetically-driven liquid atomization device according to claim 1, wherein a liquid channel is formed between the driving cavity and the extrusion cavity.

9. The electromagnetically-driven liquid atomization device according to claim 7, wherein the mouthpiece end cap is internally provided with an aerosol releasing hole to communicate with the air intake channel; and an observation window is provided on a side wall of the mouthpiece end cap.

* * * * *